US007946904B1

(12) United States Patent
Ciullo

(10) Patent No.: US 7,946,904 B1
(45) Date of Patent: May 24, 2011

(54) BRA HAVING SUPPORTIVE CAMISOLE

(76) Inventor: Sarah Ciullo, Tallahassee, FL (US)

( * ) Notice: Subject to any disclaimer, the term of this patent is extended or adjusted under 35 U.S.C. 154(b) by 485 days.

(21) Appl. No.: 12/228,182

(22) Filed: Aug. 11, 2008

(51) Int. Cl.
*A41C 3/00* (2006.01)

(52) U.S. Cl. ..... 450/7; 450/31

(58) Field of Classification Search ..... 450/7–11, 450/23–28, 15–18, 30–35, 92, 93
See application file for complete search history.

(56) References Cited

U.S. PATENT DOCUMENTS

| | | | | |
|---|---|---|---|---|
| 147,264 | A | 2/1874 | Hodgkins | |
| 862,376 | A | 8/1907 | Bachman | |
| 933,265 | A | 9/1909 | Reid | |
| 1,259,046 | A | 3/1918 | Reber | |
| 1,317,621 | A | 9/1919 | Donaldson | |
| 2,595,139 | A | 4/1952 | Hart | |
| 4,325,378 | A * | 4/1982 | Wilkinson | 450/77 |
| 4,590,945 | A | 5/1986 | Fiel | |
| 5,045,018 | A | 9/1991 | Costanzo | |
| 5,171,182 | A | 12/1992 | Heinen | |
| 5,807,160 | A | 9/1998 | Wehmeyer | |
| 6,205,585 | B1 | 3/2001 | Capparelli | |
| 6,645,041 | B2 * | 11/2003 | Sorensen | 450/36 |
| 7,591,706 | B2 * | 9/2009 | Barbour et al. | 450/23 |
| 7,666,058 | B2 * | 2/2010 | Smith | 450/8 |
| 2006/0277648 | A1 | 12/2006 | Harry | |

OTHER PUBLICATIONS

Web page at http://thewinkee.com, copyright 2007 by heART & soul studios, LLC.

* cited by examiner

*Primary Examiner* — Gloria Hale
(74) *Attorney, Agent, or Firm* — Peter Loffler

(57) ABSTRACT

A bra having a cover panel in the appearance of a camisole uses a bra construction with bra cups, with relatively wide shoulder straps that meet in a generally U-shaped joinder. A pair of torso straps extend laterally from either side of the U-shaped joinder and connect to a respective one of the bra cups, one of the two straps being in two sections with the ends of the two sections each having one portion of a typical closure, such that the closure is located under an armpit of a wearer when the bra is donned. The cover panel attaches to a lower edge of the bra and has support straps that attach to the shoulder straps substantially along the length of the shoulder straps so that the cover panel, in addition to being decorative, provides additional confinement and lift to the breasts of the wearer.

8 Claims, 5 Drawing Sheets

BRA HAVING SUPPORTIVE CAMISOLE

BACKGROUND OF THE INVENTION

1. Field of the Invention

This invention relates to a bra that has a front panel in the decorative form of a camisole wherein the camisole provides additional support to the wearer.

2. Background of the Prior Art

Many classy dresses and blouses have slightly, or even significantly plunging necklines. Such dresses are great for a night on the town. However, due to the cleavage exposure provided by the neckline, such dresses and blouses tend not to be appropriate in business and many family settings. To solve this problem, a secondary clothing layer, in the form of a camisole can be worn. However, such an additional layer can provide unwanted lines visible through the dress or blouse, and even if such visible lines are not present, the additional layer may not prove feasible in warm weather climates.

To address this problem, several devices have been proposed to eliminate the need for a full secondary layer of clothing. One such device is commonly called the bralette, which is basically a bra-like device in appearance, yet offers no support for the female breasts and is often a guy's best friend when a breeze is occasioned. Such bralettes, due to their bra-like appearance, are not appropriate when worn with low cut tops.

Another device, known as a Winkee, and found at www.thewinkee.com, is basically, a thong-like appearing device for a bra. The Winkee provides the modesty needed with an otherwise low cut dress or blouse. However, the Winkee relies on adhesives that adhere the device to the wearer. As some people are allergic to certain adhesives, and some people do perspire, such a device may not prove feasible to many.

Other cover devices have also been proposed, however, such other devices, like the Winkee, act dominantly in a decorative capacity and inoperative in providing control, molding and support of the breasts of the wearer.

What is needed is a device that allows a woman to be able to wear a low cut dress and blouse, yet have the ability to modestly cover her cleavage exposed by the low cut, without the need to don a full secondary layer of clothing. Such a device must not rely on adhesives that may contact the wearer (and may decouple therefrom should the adhesive layer become moistened due to perspiration or other cause), while also providing confinement, molding and lift for the breasts, while at the same time minimizing bra bulge.

SUMMARY OF THE INVENTION

The bra having supportive camisole of the present invention addresses the aforementioned needs in the art by providing a bra that allows a woman to be able to wear a low cut dress and blouse, yet gives the woman an appearance of modesty by covering her cleavage exposed by the low cut. Although the bra having supportive camisole does add extra fabric to what the woman wears, a full secondary layer of clothing is not donned. The bra having supportive camisole does not rely on the use of adhesives that may contact the wearer. The present invention provides confinement, molding and lift for the breasts, while at the same time minimizes bra bulge. The bra has features that achieve maximum support, lift, and confinement (The torso straps have the pull running around the body (perpendicular to the hook and eye on the strap), allowing for breathing room for the wearer. The gore has pull running up and down parallel with the center front line of the body of the wearer so that the bra is stable on the wearer. As the lower cups hold the weight of the breast, the fabric is stretched in a vertical direction. If the fabric is stretched to its limit in the downward direction, the breast has no place to go but upward, thereby forcing lift, yet does not allow for bounce and creates the best confinement for the breast. The pull of the fabric for the shoulder straps lies in a horizontal direction—if the pull is in a vertical position, the straps will act like a piece of elastic and offer little stability to the upper cup area.).

The bra having a supportive camisole of the present invention comprises a bra that has a pair of cups joined by a gore, forming a bottom edge. A pair of shoulder straps, each has a proximal end extending upwardly from a respective one of the cups and a distal end, the two distal ends meeting in a generally U-shaped joinder. A first torso strap extends between a first side of the joinder and a first one of the pair of cups while a second torso strap extends between a second side of the joinder and a second one of the pair of straps such that this second torso strap is in two sections and such that a closure is located on this second torso strap. A panel has a main panel with a lower edge, an upper edge, a first side edge, a second side edge, and a pair of spaced apart support straps. The lower edge of the main panel is attached to the bottom edge of the bra with each of the support straps attached to a respective one of the shoulder straps of the bra substantially along a length of each shoulder strap. Each support strap is attached to its respective shoulder strap at least about one half of the distance between the proximal end and the distal end of each shoulder strap. A support (wire and/or frame, etc.,) is located at the bottom edge of the bra. The side edges of the cover panel and support straps are also attached to respective outer edges of the cups and shoulder straps of the bra. The attachment line of the cover panel to the bra may be a single continuous attachment line. The lower edge of the cover panel generally coextends with the bottom edge of the bra.

BRIEF DESCRIPTION OF THE DRAWINGS

Similar reference numerals refer to similar parts throughout the several views of the drawings.

DESCRIPTION OF THE PREFERRED EMBODIMENT

Figure 1:
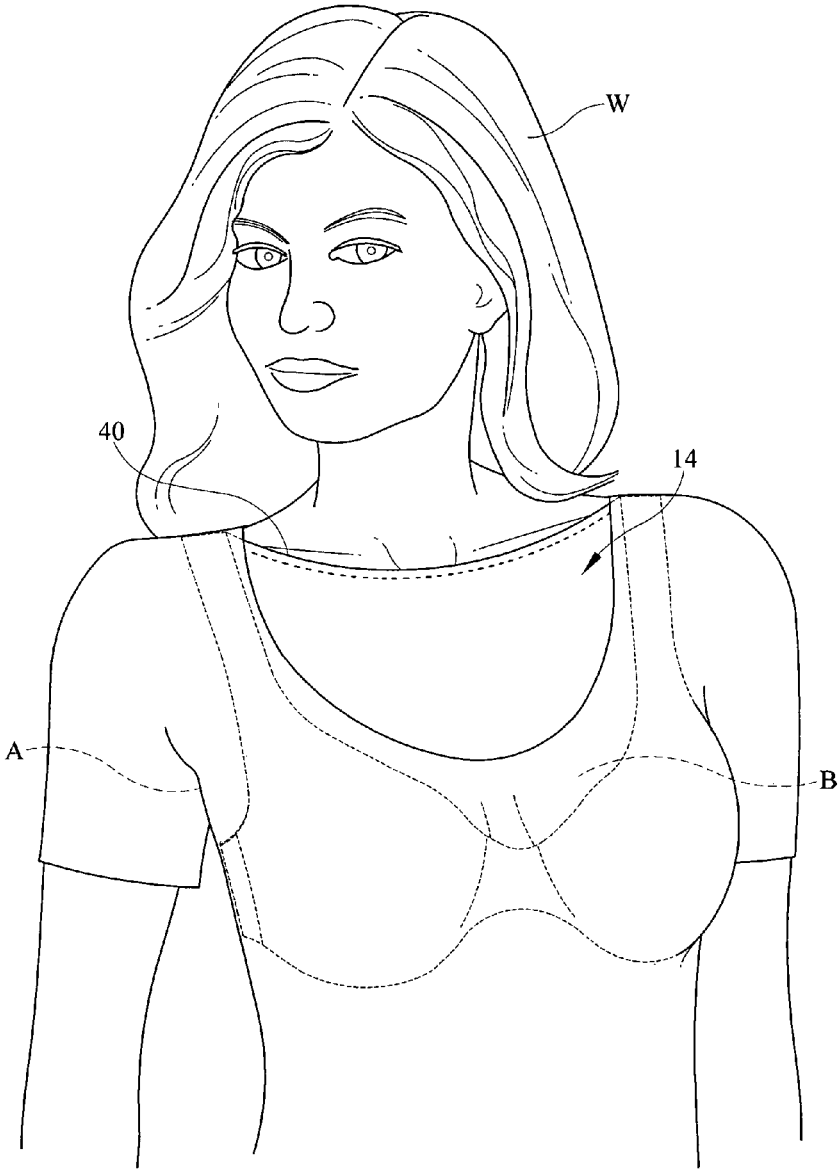
FIG. 1 is a perspective view of the bra having supportive camisole of the present invention.
Figure 2:
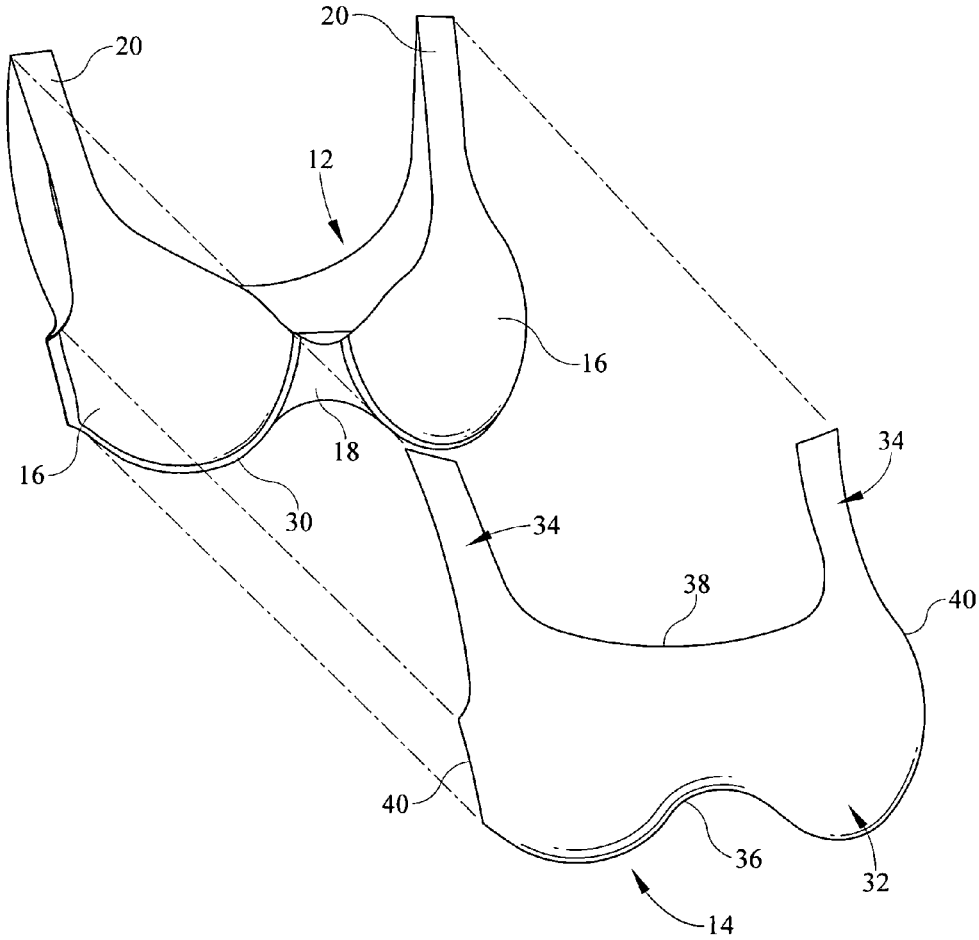
FIG. 2 is an exploded view of the two major components that comprise the bra having supportive camisole of the present invention.
Figure 3:
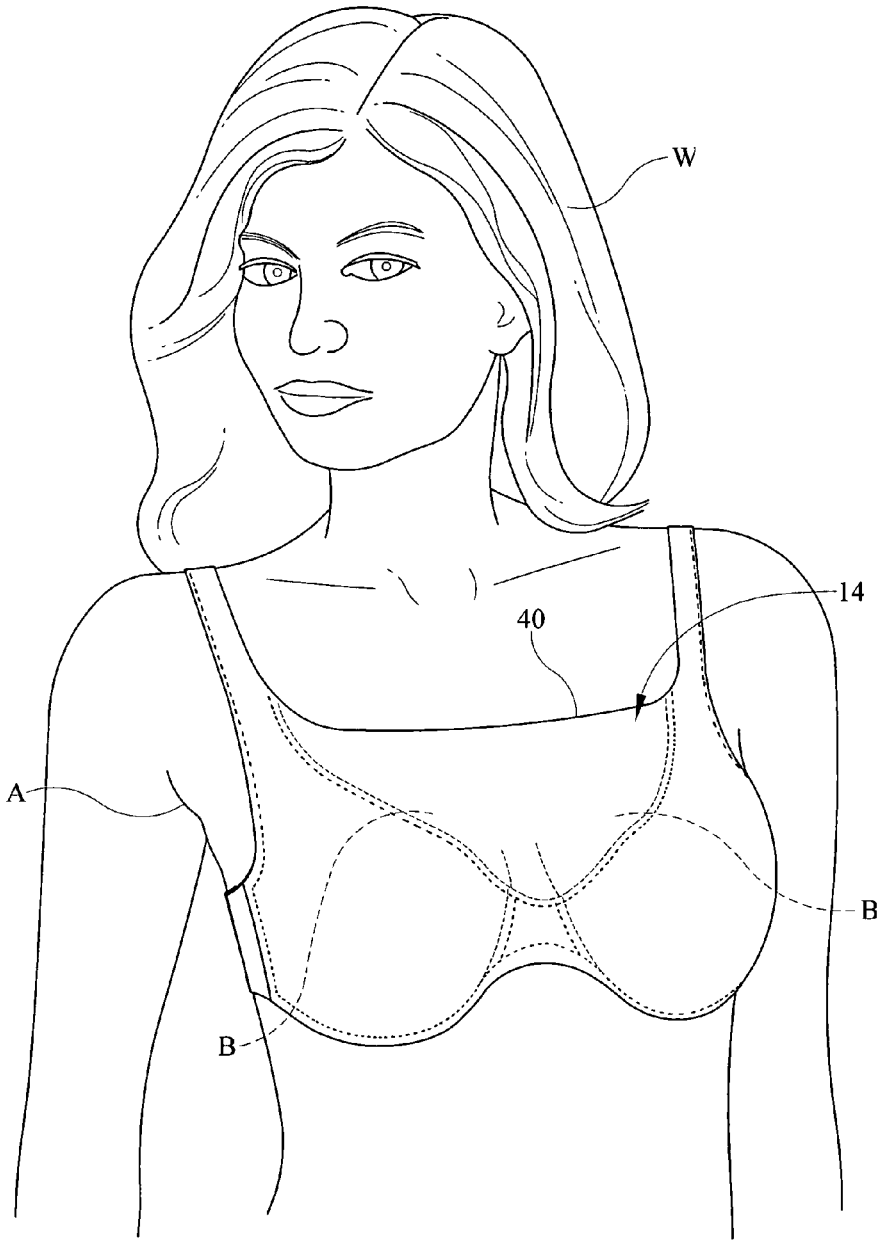
FIG. 3 is a perspective view of the bra having a supportive camisole utilizing another covering panel.
Figure 4:
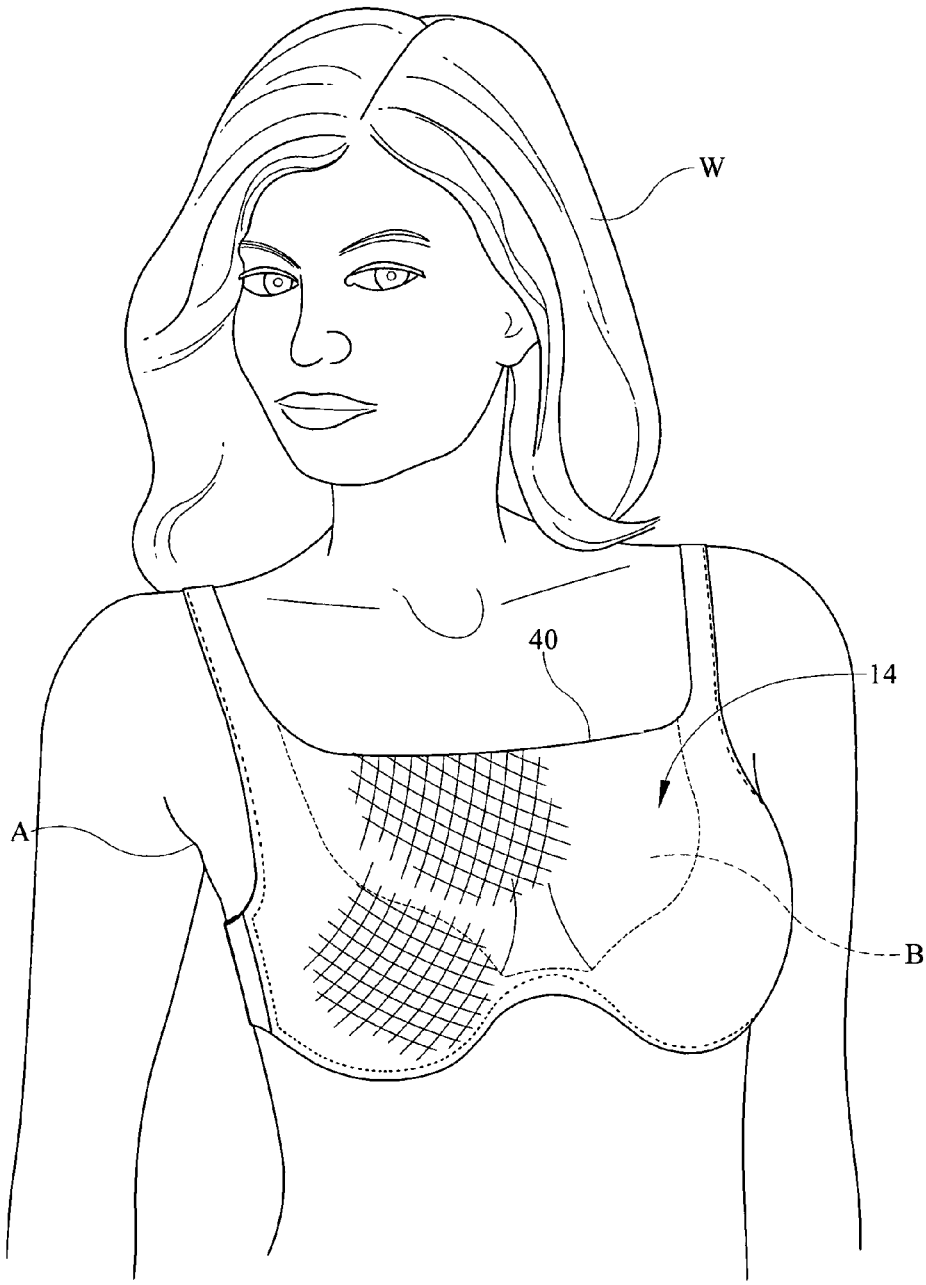
FIG. 4 is a perspective view of the bra having a supportive camisole utilizing yet another covering panel.
Figure 5:
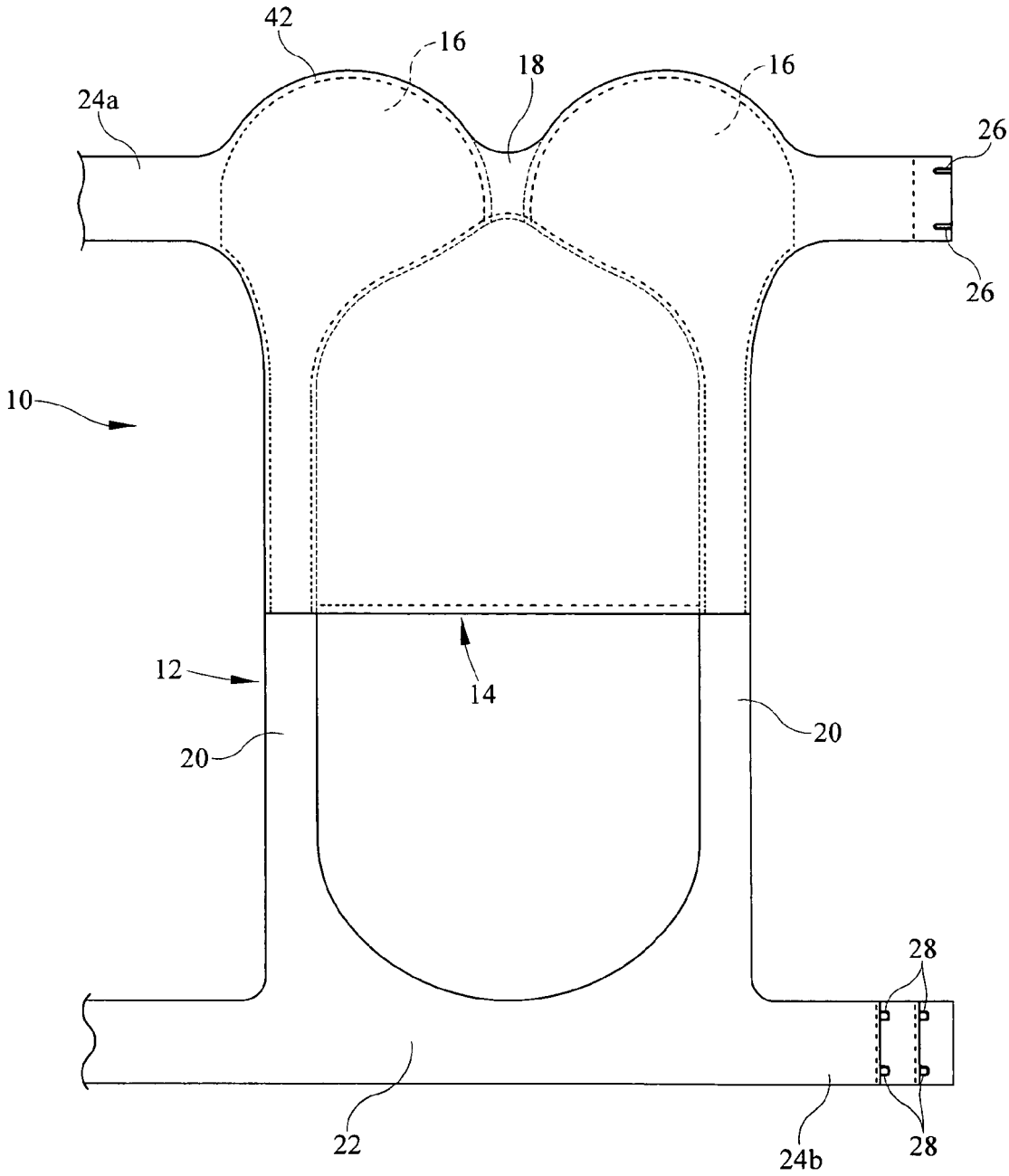
FIG. 5 is a plan view of the bra having supportive camisole.

Referring now to the drawings, it is seen that the bra having supportive camisole of the present invention, generally denoted by reference numeral 10, is comprised of two major components, a bra 12, and a covering panel 14 that is attached to the bra 12 as more fully discussed herein. Although the bra 12 may be of typical design, providing the bra 12 with certain features described herein, achieves the overall purposes of the present invention 10. The bra 12 has the typical cups 16 of the various sizes, the cups 16 connected by a central panel or gore 18. Shoulder straps 20 extend upwardly from each respective cup 16 and meet in a generally U-shaped joinder or band 22. Extending off of either side of the band 22 is a first torso strap

24*a* and a second torso strap 24*b* such that the first torso straps 24*s* connects to one side of the band 22 and one of the cups 16, and the other torso strap 24*b* connects to the other side of the band 22 and the other cup 16. One of the straps 24*b* has a discontinuity (the strap 24*b* is in two sections) such that the typical fastening hooks 26 are located on one edge of the strap 24 at the discontinuity and the hook receivers 28 are located on the other edge of the strap at the discontinuity. Other appropriate fasteners may also be used.

The bra 12 has certain architectures that are common to modern bras. The bra 12 is designed for various sized women and has an appropriate support structure 30. For a smaller breasted woman W, the bra 12 may be frameless, supported by an under wire, which may be coated with plastic, and has lightly padded demi-cups. Demi cups tend to be about one inch above the nipple or bust point in the coverage and slightly tilted and pushed toward the center front. For larger breasted women, the bra 12 may be framed and supported by a sewn structure underneath the cups. Such bras may or not have wire support and tend to have full cups with minimal or no padding for full coverage of the breasts of the wearer. Such architectures are well known in the art, and otherwise, the bra 12 is designed with appropriate features that provide support, lift, and confinement as is known in the art.

The present invention bra 12, which is made in a seamless knit construction and carries no tags or labels, has a fabric content of about 80 percent to about 90 percent Nylon and a corresponding about 20 percent to about 10 percent Spandex or Lycra content. The present invention bra 12 has substantially wider shoulder straps 20 as well as the substantially wider torso straps 24 similar to a sports bra. The generally U-shaped nature of the band provides maximum cantilevered support for the breasts of the wearer W while helping confine the breasts B of the wearer.

The covering panel 14, which is made from an appropriate material such as a cotton Spandex blend, pure silk, pure polyester lace etc., is comprised of a main panel 32 and a pair of support straps 34 extending upwardly from the main panel 32, the main panel 32 and the support straps 34 being a single monolithic unit. The main panel 32 has a lower edge 36, an upper edge 38, and side edges 40. The cover panel 14 is attached (sewn or otherwise) to the bra 12 along the various outer edges of the shoulder straps 20 and the cups 16 and the gore 18 along an attachment line 42 as seen in the figures. The lower edge 36 of the main panel 32 generally coextends with a lower edge of the cups 16 and gore 18 while the upper edge 38 of the main panel 32 extends between the shoulder straps 20 of the bra 12 at a desired cut height. As seen in FIG. 1, in a high cut design for the cover panel 14, the upper edge 38 of the main panel 32 is generally flush with the upper edge of the support straps 34. The support straps 34 are each attached to their respective shoulder strap 20 of the bra 12 substantially high up away from the main bra cups 16 (at least about one half way along the length of the shoulder straps 20). In other words, the distal end of attachment of the support straps 34 to their respective shoulder straps 20 at least at about medial point extending from the proximal end of each shoulder strap (where the shoulder strap 20 attaches to its respective cup 16) to the distal end of each shoulder strap 20 (the end where the shoulder strap 20 forms the generally U-shaped joinder). The fabric of the control panel 14 is stretched in the vertical direction in order to compliment the bra 12 by adding additional support, lift, and confinement.

The bra having a supportive camisole 10 is donned by the user W in the usual way with the wearer's breasts B being received in the cups 16 of the bra 12. The hooks 26 on the strap 24 are engaged by the receivers 28 in the usual way, except that the hooks 26 and attached receivers 28 are positioned at a side of the bra 12 underneath the wearer's armpit A. As the cover panel 14 attaches substantially high along a length of each shoulder strap 20 of the bra 12 with its fabric stretched in the vertical direction, the cover panel 14 adds additional confinement and lift to the breasts B relative to the use of a bra alone. The relatively wide nature of the shoulder straps 20 and the coextensive support straps 34 help achieve this confinement and lift. As the closure 26 and 28 of the bra 12 is located underneath an armpit A of the wearer, the potential for visible bra bulge is minimized relative to either a front or a back closure type of bra. The wearer W is now free to wear an elegant low cut dress or blouse yet achieve a desired level of modesty via the appearance of wearing a camisole, such appearance being achieved by the cover panel 14 without the need for a full secondary layer of clothing. The cover panel 14 helps the bra 12 achieve a high level of breast B confinement and lift enhancing the figure of the wearer W.

While the invention has been particularly shown and described with reference to an embodiment thereof, it will be appreciated by those skilled in the art that various changes in form and detail may be made without departing from the spirit and scope of the invention.

I claim:

1. An article of clothing comprising:

a bra having a pair of cups joined by a gore, forming a bottom edge, a pair of shoulder straps each having a proximal end attached to and extending upwardly from a respective one of the cups, a distal end of each of the pair of shoulder straps meeting in a generally U-shaped joinder, a first torso strap extending between a first side of the joinder and a first one of the pair of cups, a second torso strap extending between a second side of the joinder and a second one of the pair of straps, and a closure located on the second torso strap;

a panel member having a main panel with a lower edge, and upper edge, a first side edge, a second side edge, and a pair of spaced apart support straps, such that the lower edge of the main panel is attached to the bottom edge of the bra and such that each of the support straps is attached to a respective one of the shoulder straps of the bra substantially along a length of each shoulder strap, and wherein the article of clothing is adapted to be worn by a person such that when worn a pair of breasts of the person are each received within a respective one of the pair of cups and such that the U-shaped joinder is positioned at the rear of the person.

2. The article of clothing as in claim 1 wherein each support strap is attached to its respective shoulder strap at least about one half of the distance between the proximal end and the distal end of each shoulder strap.

3. The article of clothing as in claim 1 further comprising a support located at the bottom edge of the bra.

4. The article of clothing as in claim 1 wherein the lower edge generally coextends with the bottom edge.

5. An article of clothing comprising:

a bra having a pair of cups joined by a gore, forming a bottom edge, a pair of shoulder straps each having a proximal end attached to and extending upwardly from a respective one of the cups, a distal end of each the pair of shoulder straps meeting in a generally U-shaped joinder, a first torso strap extending between a first side of the joinder and a first one of the pair of cups, a second torso strap extending between a second side of the joinder and a second one of the pair of straps, and a closure located on the second torso strap;

a panel member having a main panel with a lower edge, and upper edge, a pair of side edges, and a pair of spaced apart support straps, such that the lower edge of the main panel is attached to the bottom edge of the bra, the pair of side edges are attached to a respective outer edge of each of the pair of cups and the pair of shoulder straps, and such that each of the support straps is attached to a respective one of the shoulder straps of the bra substantially along a length of each shoulder strap, and wherein the article of clothing is adapted to be worn by a person such that when worn a air of breasts of the erson are each received within a respective one of the pair of cups and such that the U-shaped joinder is positioned at the rear of the person.

6. The article of clothing as in claim 5 wherein each support strap is attached to its respective shoulder strap at least about one half of the distance between the proximal end and the distal end of each shoulder strap.

7. The article of clothing as in claim 5 further comprising a support located at the bottom edge of the bra.

8. The article of clothing as in claim 5 wherein the lower edge generally coextends with the bottom edge.

* * * * *